US005815637A

United States Patent [19]

Allen et al.

[11] Patent Number: 5,815,637

[45] Date of Patent: Sep. 29, 1998

[54] HUMIDIFIER FOR CONTROL OF SEMI-CONDUCTOR MANUFACTURING ENVIRONMENTS

[75] Inventors: Stuart V. Allen, Gilroy; Robert Bruce Eglinton, Carmel, both of Calif.

[73] Assignee: Semifab Corporation, Hollister, Calif.

[21] Appl. No.: 645,341

[22] Filed: May 13, 1996

[51] Int. Cl.[6] ..... F22B 1/28; F24F 3/14

[52] U.S. Cl. ..... 392/400; 392/402

[58] Field of Search ..... 392/394, 396, 392/400, 401, 402, 403; 122/4 A, 460, 461, 463, 465, 466

[56] References Cited

U.S. PATENT DOCUMENTS

| | | | |
|---|---|---|---|
| 1,756,053 | 4/1930 | Colton | 392/402 |
| 1,758,922 | 5/1930 | Berg | 392/400 |
| 2,311,199 | 2/1943 | Astradsson | 392/402 |
| 2,883,511 | 4/1959 | Gooldy | 392/400 |
| 3,365,567 | 1/1968 | Smith et al. | 392/402 |

*Primary Examiner*—Teresa J. Walberg
*Assistant Examiner*—Sam Paik
*Attorney, Agent, or Firm*—Fulwider Patton Lee & Utecht, LLP

[57] ABSTRACT

The humidifier for controlling humidity in a semi-conductor manufacturing environment provides a trickle water refill level control system for maintaining an accurate flow of refill water into the humidifier water tank. A water supply provides a substantially constant rate of flow of water to a conduit connected between the humidifier tank inlet port and the water overflow tank inlet port, to allow the excess water supplied to the humidifier water tank to flow to the overflow tank. The overflow tank has a float level control allowing for operation of the steam generating humidifier at higher steam pressures, and increased stability of the steam generation rate. A pressure equalization line is also connected between an upper portion of the humidifier water tank and an upper air reservoir of the water overflow tank for equalizing pressure between the humidifier water tank and the water overflow tank.

18 Claims, 1 Drawing Sheet

HUMIDIFIER FOR CONTROL OF SEMI-CONDUCTOR MANUFACTURING ENVIRONMENTS

BACKGROUND OF THE INVENTION

1. Field of the Invention

This invention relates generally to systems for semiconductor fabrication, and more particularly concerns an improved humidifier system for humidity controlled semiconductor manufacturing environments.

2. Description of Related Art

Processing of materials such as wafers, cassettes of wafers or substrates used in manufacturing integrated circuits has been conventionally carried out in a carefully temperature and humidity controlled, particulate free environment generally known as a "clean room". Such environments are used to protect contaminant sensitive products such as wafers, masks, ceramic substrates, flat panel displays, and the like during processing. Maintenance of such "clean rooms" in a temperature and humidity controlled, contaminant free state can require a great deal of care and effort, particularly during processing of the materials.

In a conventional humidifier such as is commonly used in maintaining a proper humidity level in such manufacturing environments, an accurate, consistent, and stable level of water vapor production is desirable. However, a stable rate of water vapor production is typically dependent upon a stable water level in the humidification tank. In conventional steam humidifiers, for example, the level of water in the steam humidification tank is typically maintained with solenoid valves and water level switches, or with a float valve. However, when regulated only by common float switch and solenoid valve systems or float valve systems, the water level in such steam humidification tanks can fluctuate, so that such conventional system generally do not achieve accurate, consistent, and stable levels of steam production. It is therefore desirable to provide an improved system for maintaining consistent, stable levels of water vapor production by accurately controlling the water level of the humidifier water tank.

Conventional steam humidifiers for "clean room" manufacturing environments also commonly have a water tank overflow outlet with a P-trap, to allow for overflow while keeping preventing steam from escaping through the overflow outlet. As is shown in FIG. 1, such a prior art steam humidifier typically includes an overflow tube 4 with a lower portion 5 forming a P-trap, connected to an elevated portion 6 of the overflow tube leading to a drain. The P-trap is filled with water to prevent the escape of steam through the overflow tube, and steam pressure in the overflow tube displaces the water in the P-trap to the upper water level 8. Steam is typically generated in a steam humidifier water tank 12, having a water level 13, a heater component 16, and a steam distribution tube 18 with steam nozzles 20. With such a standard P-trap arrangement, the steam pressure in the tank is limited by the height of the elevated portion 6 of the overflow tube. Steam pressure can also blow the water out of the trap, particularly when the humidifier is started from a cold tank, since steam pressure in the tank commonly can overshoot its controlled set point when the water in the tank first reaches the boiling point. It is therefore also desirable to provide a steam humidifier that would provide for overflow and would allow the steam humidifier to operate at higher steam pressures. The present invention meets these needs.

SUMMARY OF THE INVENTION

Briefly, and in general terms, the present invention provides for a humidifier for controlling humidity in a semiconductor manufacturing environment with a trickle water refill level control system for maintaining an accurate flow of refill water into the humidifier water tank, to provide for a more accurate and controllable water vapor generation rate. The humidifier is preferably a steam humidifier having an overflow tank provided with a float level control allowing for operation of the steam humidifier at higher steam pressures, allowing for increased stability of the steam generation rate.

The improved humidifier of the invention for controlling humidity in a semi-conductor manufacturing environment accordingly comprises a water vapor generator for distributing water vapor in the semi-conductor manufacturing environment, and in one presently preferred embodiment the water vapor generator comprises a steam generator. Alternatively, other types of water vapor generators may also be suitable, such as an ultrasonic water vapor generator, for example. A water supply provides a substantially constant rate of flow of water to the humidifier water tank. To ensure that the water level in the humidifier water tank is stable, the rate of flow of water to the humidifier water tank is slightly greater than the rate of water consumed by water vapor generation, and a conduit is connected in fluid communication between the humidifier tank inlet port and the water overflow tank inlet port, to allow the excess water supplied to the humidifier water tank to flow to the overflow tank.

In one presently preferred embodiment, in which the humidifier is a steam humidifier, a pressure equalization line is connected in fluid communication between an upper portion of the humidifier water tank and an upper air reservoir of the water overflow tank for equalizing pressure between the humidifier water tank and the water overflow tank. A float valve is also provided for draining excess water from the water overflow tank when the water in the water overflow tank rises above a predetermined level. The water and float valve in the bottom of the water overflow tank act as a seal, allowing the humidifier to operate at higher steam pressures.

In a presently preferred embodiment, a float switch is also provided in the water overflow tank for sensing when the water level in the water overflow tank rises above a predetermined maximum level. A flow control valve is provided in the water supply for restricting water flow from the water supply to the humidifier water tank responsive to the float switch when the water level in the water overflow tank rises above the predetermined maximum level.

These and other aspects and advantages of the invention will become apparent from the following detailed description, and the accompanying drawings, which illustrate by way of example the features of the invention.

DETAILED DESCRIPTION OF A PREFERRED EMBODIMENT

In conventional humidifiers regulated by common float switch and solenoid valve systems or float valve systems, the water level in the humidifier water tanks of such humidifiers can fluctuate. Such fluctuations in the water level of the humidifier water tank can generally adversely affect the accuracy, consistency and stability of levels of water vapor production.

Figure 1:
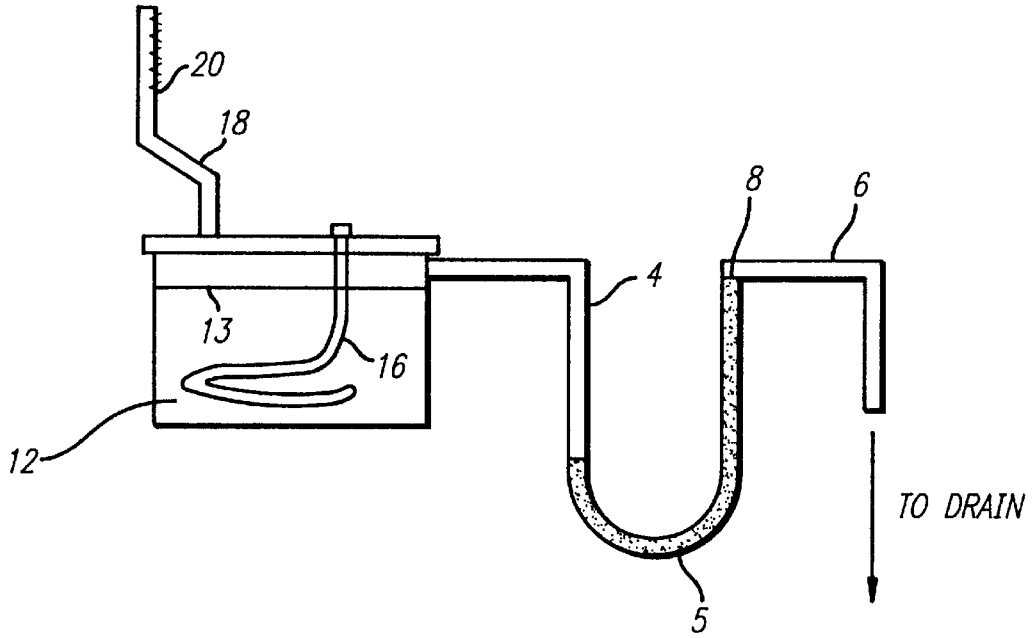
FIG. 1 PRIOR ART
FIG. 1 is a schematic diagram of a prior art humidifier.
Figure 2:
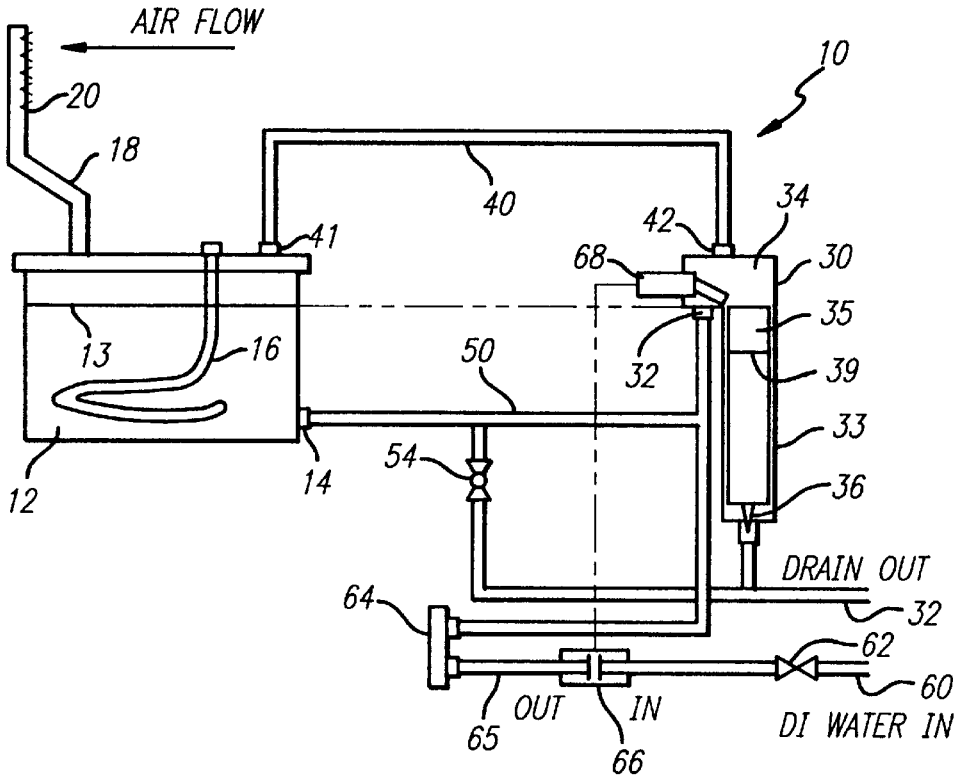
FIG. 2 is a schematic diagram of the humidifier of the invention for controlling humidity in a semi-conductor manufacturing environment.

As is illustrated in the FIG. 2, the invention accordingly is embodied in a humidifier 10 for control of humidity in a semi-conductor manufacturing environment. The humidifier of the invention is currently preferably a steam humidifier, having a steam humidifier water tank 12, a water level 13, a water inlet port 14 located near or in the bottom of the tank, and an electrical immersion heater 16 for generating steam in the steam humidifier water tank. An outlet steam distribution tube 18 is connected at or near the top of the steam humidifier water tank for directing the steam from the tank through a plurality of small diameter orifices or nozzles 20, into a moving air stream provided in the semi-conductor manufacturing environment.

A separate external water overflow water tank 30 has a water inlet port 32, receiving water from the same water line that supplies the steam humidifier water tank as will be further described below. The overflow water tank is positioned relative to the steam humidifier water tank so that the point at which the supply water enters the overflow tank determines the water level 13 in the steam humidifier water tank. The overflow water tank also includes an upper air reservoir portion or chamber 34 disposed above the water overflow tank water inlet port. The overflow water tank is typically formed in an inverted L shape, with the upper air reservoir portion or chamber extending horizontally perpendicular to the lower upright main water tank portion 33 of the overflow water tank. A float 35 with a float valve 36 disposed in the lower portion of the overflow water tank is connected to a drain 38. The float valve operates to maintain a stable water level 39 in the overflow tank despite steam pressure in the steam humidifier water tank, communicated to the overflow water tank by pressure equalization line 40 connected between the top of humidifier tank 41 and the overflow tank top seal 42 at the top of the air reservoir chamber. The pressure equalization line connecting the upper portions of the steam humidifier tank and the overflow tank above the water level prevents the steam pressure in the steam humidifier tank from forcing the water level in the steam humidifier tank below the level in the overflow tank. The water in the bottom of the overflow tank preserves high steam pressure in the humidifier tank by acting as a seal and preventing steam from leaking into the drain, and allowing the humidifier to operate at relatively high steam pressures.

A conduit or tube 50 is connected between the steam humidifier tank inlet port 14 and overflow inlet port 32. The conduit is preferably L shaped, and is connected through a drain valve 54 to the drain 38. A water supply source 60 of preferably deionized water is connected in fluid communication with the conduit 50, and preferably provides a water supply flow in a continuous trickle rate controlled by regulator 62 and set by a flowmeter 64 in the water supply line 65. The flow rate can be set so that it always exceeds the demand of the steam humidifier tank, so that the water level in the steam humidifier tank remains substantially constant at all times.

To initialize operation of the humidifier system of the invention, a small flow of water is typically introduced into the L shaped conduit through the water supply line, filling both the humidifier tank and the L shaped conduit 50. The water level rises in the humidifier water tank until the water begins to overflow through the L shaped conduit into the overflow tank, after which the level of water in the humidifier tank and in the vertical leg of the L shaped conduit will remain at the height of the inlet port to the overflow tank, as long as the flow of refill water is greater than the amount of water converted to water vapor by the humidifier. As water is boiled out of the steam humidifier tank, a portion of the water flow that is exactly equal to the amount of water boiled off flows through the bottom leg of the L shaped conduit and into the humidifier water tank. Excess flow of refill water flows out of the vertical leg of the L shaped conduit, and through the inlet port of the overflow tank. The float valve in the bottom of the overflow tank meters the flow of water into the drain to maintain a stable water level in the overflow tank.

The air reservoir in the top of the overflow water tank separates saturated steam in the steam humidifier water tank from cold refill water from the water supply flowing out of the conduit 50. If the air reservoir is depleted by a leak, steam can condense into the cold water in the overflow water tank. Such a flow of condensing steam can cause a pressure differential between the humidifier water tank and the top of the connecting conduit, causing the water level and the flow of cold refill water into the humidifier to become unstable, which consequently can cause the steam generation rate to become unstable.

In a presently preferred embodiment, as an added safety feature, a flow control solenoid valve 66 is provided in the water supply line 65 for shutting off or otherwise restricting water flow from the water supply to the humidifier water tank when the water in the water overflow tank rises above a predetermined maximum level in the overflow tank. A float switch 68 provided at the predetermined maximum water level in the overflow tank senses when water in the water overflow tank rises above the predetermined maximum level, and generates an overflow signal indicating the overflow condition. The solenoid valve is electrically connected to the float switch, and is activated to shut off or otherwise restrict the supply water flow in response to the overflow signal. Thus, if the float valve in the overflow tank fails to function properly, allowing the steam humidifier tank and overflow tank to overfill, the float switch will cause the solenoid valve to shut off or otherwise restrict the water supply.

In extensive testing of the improved humidifier system of the invention, it has been found that the accuracy of humidity control can be substantially increased from ±0.5–0.6% previously achievable with conventional steam humidifiers, to a humidity accuracy of ±0.2–0.3% with the improved humidifier system of the invention.

In view of the foregoing, it has been demonstrated that the humidifier system of the invention allows for a more accurate and controllable water vapor generation rate, to permit the humidity in a semiconductor manufacturing environment to be accurately controlled, by maintaining an accurate flow of refill water into the humidifier water tank. The humidifier system of the invention maintains constant water levels in both the humidifier water tank and the water overflow tank, and maintains a constant volume of air space in the tanks at all times, regardless of the rate of water flow into the system, and regardless of the water vapor pressure, eliminating fluctuations in water vapor generation.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A humidifier for controlling humidity in a semiconductor manufacturing environment, comprising:

a water vapor generator for distributing water vapor in the semi-conductor manufacturing environment, said water vapor generator having a water tank with a water inlet port;

a water supply in fluid communication with the water vapor generator for providing a substantially constant rate of flow of water to said water vapor generator water tank;

a water overflow tank having a water inlet port; and a conduit connected in fluid communication between the water vapor generator water tank inlet port and the water overflow tank inlet port, whereby said water overflow tank receives water overflow from said water vapor generator water tank through said conduit.

2. The humidifier of claim 1, wherein said water overflow tank further comprises a float valve disposed at a lower portion of the lower water containing portion for draining water from said water overflow tank when the water in said water overflow tank rises above a predetermined level in said water overflow tank.

3. The humidifier of claim 1, wherein said water overflow tank comprises an upper air reservoir portion disposed above said water overflow tank water inlet port.

4. The humidifier of claim 3, wherein said water vapor generator comprises a steam generator, and further comprising a pressure equalization line connected in fluid communication between an upper portion of the water vapor generator water tank and the air reservoir of the water overflow tank for equalizing pressure between said water vapor generator water tank and said water overflow tank.

5. The humidifier of claim 1, wherein said conduit connected in fluid communication between the water vapor generator water tank inlet port and the water overflow tank inlet port is L shaped.

6. The humidifier of claim 1, wherein said water overflow tank is L shaped.

7. The humidifier of claim 1, further comprising a float switch in the water overflow tank for sensing when water in the water overflow tank rises above a predetermined maximum level, and said water supply further includes a flow control valve for restricting water flow from said water supply to said water vapor generator water tank inlet port responsive to said float switch when the water in the water overflow tank rises above said predetermined maximum level.

8. A humidifier for controlling humidity in a semiconductor manufacturing environment, comprising:

a steam generator for distributing steam in the semiconductor manufacturing environment, said steam generator having a water tank with a water inlet port;

a water supply in fluid communication with the steam generator water tank for providing a substantially constant rate of flow of water to said steam generator water tank;

a water overflow tank having a water inlet port; and a conduit connected in fluid communication between the steam generator water tank inlet port and the water overflow tank inlet port, whereby said water overflow tank receives water overflow from said steam generator water tank through said conduit.

9. The humidifier of claim 8, wherein said water overflow tank further comprises a float valve disposed at a lower portion of the lower water containing portion for draining water from said water overflow tank when the water in said water overflow tank rises above a predetermined level in said water overflow tank.

10. The humidifier of claim 8, wherein said water overflow tank comprises an upper air reservoir portion disposed above said water overflow tank water inlet port.

11. The humidifier of claim 10, further comprising a pressure equalization line connected in fluid communication between an upper portion of the steam generator water tank and the air reservoir of the water overflow tank for equalizing pressure between said steam generator water tank and said water overflow tank.

12. The humidifier of claim 8, wherein said conduit connected in fluid communication between the steam generator water tank inlet port and the water overflow tank inlet port is L shaped.

13. The humidifier of claim 8, wherein said water overflow tank is L shaped.

14. The humidifier of claim 8, further comprising a float switch in the water overflow tank for sensing when water in the water overflow tank rises above a predetermined maximum level, and said water supply further includes a flow control valve for restricting water flow from said water supply to said steam generator water tank inlet port responsive to said float switch when the water in the water overflow tank rises above said predetermined maximum level.

15. A humidifier for controlling humidity in a semiconductor manufacturing environment, comprising:

a steam humidifier having a water tank with a water inlet port, a heater for generating steam from water in the water tank, and a steam distribution tube connected to the water tank for distributing steam in the semiconductor manufacturing environment;

a water overflow tank having an upper air reservoir portion and a lower water containing portion, a water inlet port disposed at a lower portion of the air reservoir, and a float valve disposed at a lower portion of the lower water containing portion connected to a drain;

a pressure equalization line connected in fluid communication between an upper portion of the humidifier tank and the air reservoir of the water overflow tank;

a conduit connected in fluid communication between the humidifier tank inlet port and the water overflow tank inlet port; and a water supply in fluid communication with the conduit for providing a substantially constant rate of flow of water to said steam humidifier water tank.

16. The humidifier for controlling humidity in a semiconductor manufacturing environment of claim 15, wherein said conduit connected in fluid communication between the humidifier tank inlet port and the water overflow tank inlet port is L shaped.

17. The humidifier for controlling humidity in a semiconductor manufacturing environment of claim 15, wherein said water overflow tank is L shaped.

18. The humidifier for controlling humidity in a semiconductor manufacturing environment of claim 15, further comprising a float switch in the water overflow tank for sensing water in the water overflow tank rises above a predetermined maximum level, and said water supply further includes a flow control valve for restricting water flow from said water supply to said humidifier tank water inlet port responsive to said float switch when the water in the water overflow tank rises above said predetermined maximum level.

* * * * *